United States Patent [19]

Maziasz et al.

[11] Patent Number: 4,849,169

[45] Date of Patent: Jul. 18, 1989

[54] HIGH TEMPERATURE CREEP RESISTANT AUSTENITIC ALLOY

[75] Inventors: Philip J. Maziasz; Robert W. Swindeman, both of Oak Ridge; Gene M. Goodwin, Lenoir City, all of Tenn.

[73] Assignee: The United States of America as represented by the United States Department of Energy, Washington, D.C.

[21] Appl. No.: 193,705

[22] Filed: May 13, 1988

[51] Int. Cl.[4] ..... C22C 30/00

[52] U.S. Cl. ..... 420/584; 420/53; 420/586

[58] Field of Search ..... 420/586.1; 148/442

[56] References Cited

FOREIGN PATENT DOCUMENTS 59-060101 10/1983 Japan ..... 420/586.1
58-177439 4/1984 Japan ..... 420/586.1
60-116750 6/1985 Japan ..... 420/586.1

OTHER PUBLICATIONS

Swindeman et al, "Procurement and Screening Test Data for Advanced Austenitic Alloys for 650° C. Steam Service," ORNL/TM-10206/P1.

*Primary Examiner*—L. Dewayne Rutledge
*Assistant Examiner*—David Schumaker
*Attorney, Agent, or Firm*—Katherine P. Lovingood; Stephen D. Hamel; Judson R. Hightower

[57] ABSTRACT

An improved austenitic alloy having in wt % 19–21 Cr, 30–35 Ni, 1.5–2.5 Mn, 2–3 Mo, 0.1–0.4 Si, 0.3–0.5 Ti, 0.1–0.3 Nb, 0.1–0.5 V, 0.001–0.005 P, 0.08–0.12 C, 0.01–0.03 N, 0.005–0.01 B and the balance iron that is further improved by annealing for up to 1 hour at 1150°–1200° C. and then cold deforming 5–15 %. The alloy exhibits dramatically improved creep rupture resistance and ductility at 700° C.

4 Claims, 2 Drawing Sheets

HIGH TEMPERATURE CREEP RESISTANT AUSTENITIC ALLOY

This invention is an austenitic alloy of Fe—20-Cr—30Ni with 2% Mo and closely controlled quantities of minor constituents that include Ti, Nb, V, P, B and N and was developed pursuant to contract DE-AC05-840R21400 with the U.S. Department of Energy.

BACKGROUND OF THE INVENTION

Conventional steam powered plants burning pulverized coal continue to provide a major portion of the nation's electric power generation. Improvements in thermal efficiency of these plants will require the use of steam cycles operating at higher temperatures and pressures than those presently used. Since the materials that are now available are limited in their physical capabilities, steam conditions must be closely controlled.

Research is currently being pursued at Oak Ridge National Laboratory (ORNL) to develop austenitic alloys for use as superheater/reheater tubes in boilers of advanced steam cycle fossil power plants which must be able to withstand temperatures of 650°-700° C. with 35 MPa steam pressure inside. There is a need for alloys with improved strength but without disadvantageous physical properties such as difficulty of fabrication or susceptibility to corrosion. Alloys previously developed, and defined in the Table contained in this application, have drawbacks that need to be overcome. Alloy 617 is a superalloy that could meet strength and corrosion requirements for boiler tubing of an advanced steam-cycle power plant, but since it is high in Cr, Mo, Co and Ni it is about five times more expensive than a typical type 304 316, or 347 austenitic stainless steel. These conventional 300-series steels are employed as boiler tubes in existing fossil power plants today, but their strength and corrosion resistance limit both metal temperature and steam pressure to about 540° C. and 24 MPa, respectively.

Recent research at ORNL for advanced steam cycle boiler materials has produced several "lean" (14Cr) austenitic stainless steels with outstanding creep rupture strength at 700 C., approaching that of alloy 617. This was done using minor alloying element compositional modifications that produce specific precipitate microstructures directly resulting in an improvement in properties. However, despite their creep strength, the lower Cr content of these alloys demands that they be protected against fire- and steam-side corrosion by cladding or chromizing.

The closest conventional higher chromium alloys to those new alloys under development at ORNL are alloys 800 and 800H, which have been the subject of study for use in nuclear applications such as vessel or core components for high temperature gas cooled reactors or liquid metal fast breeder reactors. The alloys, particularly 800H, have also been used in the petrochemical industry due to their good resistance to corrosion. Alloy 800H, with 20Cr—30Ni, is a candidate for use in steam applications since it adequately resists steam-side corrosion; however, its strength at elevated temperatures can be affected by precipitation of $\gamma'$ [$Ni_3$-(Al,Ti)] at 500°-650° C. or precipitation of $M_{23}C_6$ and/or MC at higher temperatures. Other efforts to modify 800H for non-nuclear applications such as advanced steam cycle boiler tubes involve the removal of Ti and/or Al and the addition of Mo and Nb.

SUMMARY OF THE INVENTION

In view of the above mentioned needs it is an object of the present invention to provide an alloy that is an improvement over alloy 800H for use in high temperature applications requiring good creep strength, rupture resistance and corrosion resistance.

It is another object of this invention to provide a thermal-mechanical treatment to be used in conjunction with the alloy to improve the properties of the basic alloy.

It is still another object of the invention to provide an alloy that has specific matrix and grain boundary microstructures that develop from synergistic interaction of alloying elements and directly improve strength and ductility during high temperature exposure.

A further object of this invention is to provide critical limits on the alloy composition to minimize heat to heat variations in properties yet preserve the weldability of the alloys. Additional objects, advantages and novel features of the invention will be set forth in part in the description which follows, and in part will become apparent to those skilled in the art upon examination of the following or may be learned by practice of the invention. The objects and advantages of the invention may be realized and attained by the combinations particularly pointed out in the appended claims.

To achieve the foregoing and other objects and in accordance with the purpose of the present invention, the composition of matter may comprise an austenitic alloy composition having in wt % 19-21 Cr, 30-35 Ni, 1.5-2.5 Mn, 2-3 Mo, 0.1-0.4 Si, 0.3-0.5 Ti, 0.1-0.3 Nb, 0.1-0.5 V, 0.001-0.005 P, 0.08-0.12 C, 0.01-0.03 N, 0.005-0.01 B and the balance iron. The invention may further comprise the above described alloy which is subjected to a thermal-mechanical treatment of annealing for up to 1 hour at 1150°-1200° C. and then cold deforming 5-15% or hot finishing sufficiently to produce yield strengths in the 300 to 600 MPa range. The result is a weldable alloy with improved creep resistance and corrosion resistance at temperatures above 700° C. An added advantage is that the thermal-mechanical treatment applied prior to service to maximize strength is uncomplicated thereby lessening the cost that would be associated with a more difficult process.

DETAILED DESCRIPTION OF THE PREFERRED EMBODIMENT

Figure 1:
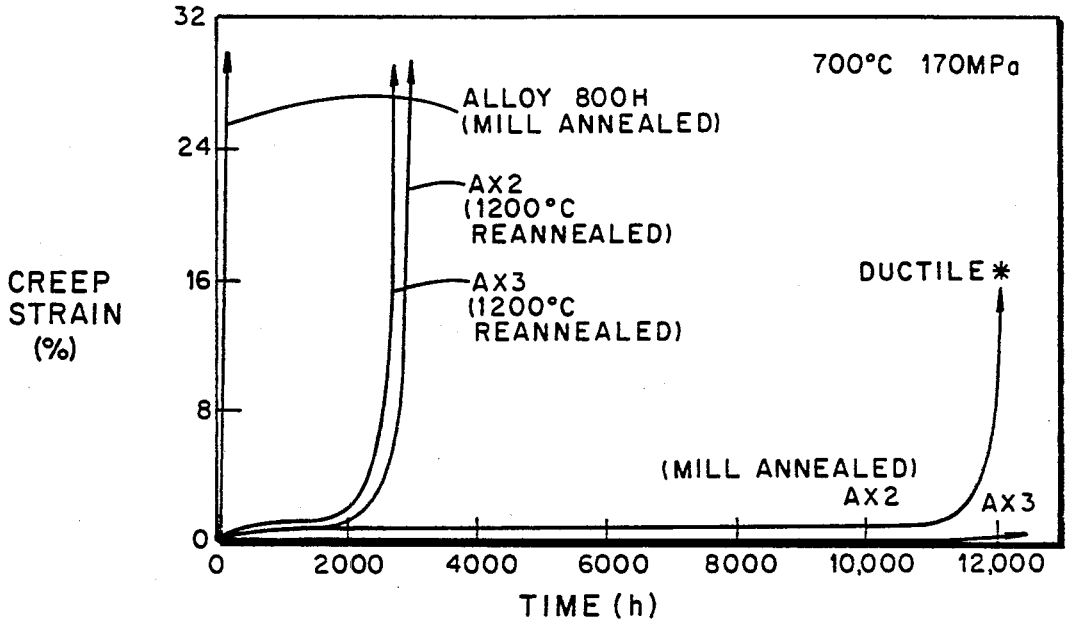
FIG. 1 shows the creep-rupture lifetime at 700° C. and 170 MPa of the subject alloys AX2 and AX3 in the reannealed (as-received +1h at 1200° C.) condition (RA), and in the mill-annealed (as-received +5-15% cold work) condition (MA) relative to MA alloy of 800H.

The invention is an alloy as well as an alloy that has been subjected to specific thermal-mechanical treatment prior to service and the compositions that have been prepared are set forth in the Table as AX1, AX2, AX3 and AX4. They differ from alloy 800H in that (a) Ti is not eliminated, but is rather the major carbide forming element added, (b) C is higher than N, (c) Nb/C ratio is higher than in the 800H alloy, (d) Mn and Mo levels are higher, (e) Si is lower, and (f) P, B and V are intentionally added.

TABLE 1

| Alloy | Cr | Ni | Mo | Mn | Si | Ti | Nb | V | C | P | B | N | Cu | Al |
|---|---|---|---|---|---|---|---|---|---|---|---|---|---|---|
| | | | | | Composition (wt. %)[a] | | | | | | | | | |
| 800[b] | 19–23 | 30–35 | | 1.5[c] | 1[c] | .15–.6 | | | .1[c] | | | | .75[c] | .15–.6 |
| 800H[b] | 19–23 | 30–35 | | 1.5[c] | 1[c] | .15–.6 | | | .05–.1 | | | | .75[c] | .15–.6 |
| 800H[d] | 19.5 | 32 | | .9 | .24 | .42 | | | .08 | | | | .5 | .43 |
| AX1* | 19.6 | 30 | 2 | 2 | .2 | .27 | .21 | .52 | .09 | .074 | .005 | .024 | | |
| AX2* | 20.4 | 30.4 | 2 | 2 | .23 | .36 | .24 | .53 | .09 | .045 | .01 | .028 | | |
| AX3* | 20.6 | 30.6 | 2 | 2 | .22 | .36 | .24 | .52 | .09 | .031 | .01 | .029 | | |
| AX4* | 25.2 | 30.3 | 2 | 2 | .22 | .36 | .24 | .53 | .09 | .072 | .01 | .03 | | |
| 617[e] | 23 | 55 | 9 | .2 | .2 | .5 | | | .06 | | | | | |
| CR30A[f] | 30 | 51 | 2 | .2 | .3 | .2 | | | .06 | | | | | .14 |

[a]balance Fe
[b]general composition range
[c]maximum limit
[d]specific alloy produced by HUNTINGTON ALLOYS, INC. for ORNL
*modified 800H alloys developed at ORNL and produced by AMAX, INC.
[e]also contains 12 wt. % Co
[f]TEMPALOY, trademark of NKK - Japan The alloy is made by conventional industry melting practices that include electro-slag remelting or induction melting techniques, including controlled gas or vacuum environments.

The specific alloying additions as well as the proportions are critical since there are various synergistic interactions among many of the elements. For example, Ti, Nb and V must be present together for optimized MC formation. Additionally B and P must be present together in the presence of Ti, Nb and V to maximize their effect. Also C and N must be present together in the presence of Ti, Nb and V and the concentration of C must be higher than that of N to optimize the effectiveness of those alloying additions. The elements Ti, V and P must also be present together for enhanced FeTiP formation. These minor elements are further synergistically effected by the presence of Si which is added for fluidity and yet restricted to prevent intermetallic phase formation while Mo is added for high temperature strength, recrystallization resistance and positive phase effects. Mn is present to further stabilize the austenite, the face-centered-cubic crystal structure of the matrix phase. The alloy and the treatment permit a tailored precipitate microstructure of fine, stable MC carbides and/or phosphides to develop for strength during service. The limits on P content are intended to allow the alloy to be weldable without compromising strength.

Figure 2:
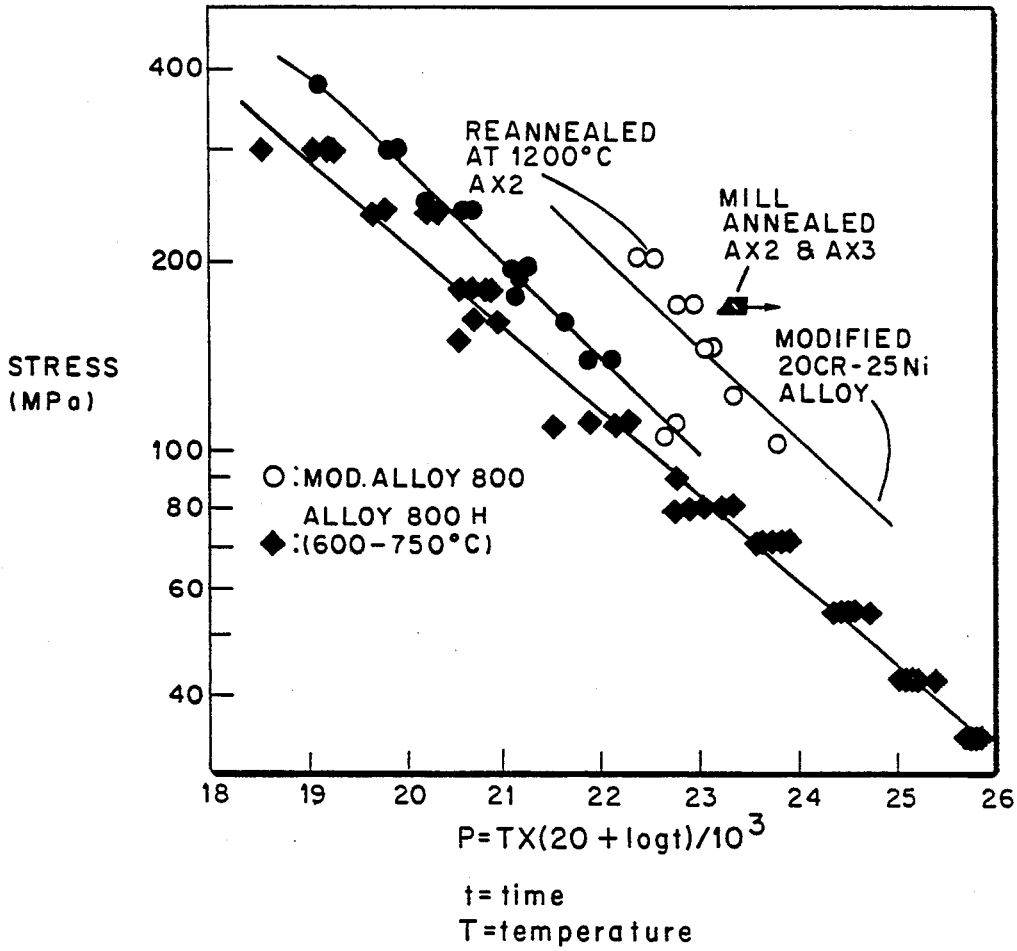
FIG. 2 compares creep stress versus rupture life of a modified alloy 800H and a closely related modified 20Cr—25Ni steel alloy to the alloy of the invention.

FIG. 1 demonstrates that the creep-rupture lifetime at 700° C. and 170 MPa of the subject alloys AX2 and AX3 is about 20 times longer in the reannealed (as-received +1h at 1200° C.) condition (RA), and about 100 times longer in the mill-annealed (as-received, including 5–15% cold work) condition (MA) relative to MA alloy of 800H. Rupture resistance is excellent over the range of P levels shown in Table 1, and AX2 and AX3 define the limit on P which produces acceptable welding behavior. FIG. 2 compares creep stress versus rupture life on another version of a modified alloy 800H disclosed in K. Tamura, et al. "Study on Applicability of Tubing and Piping materials for Improved Coal-Fired Power Boiler," Proc. First Inter. Conf. IMPROVED COAL-FIRED POWER PLANTS, EPRI, 1987 and on a closely related modified 20Cr—25Ni stainless steel disclosed in H. Masumoto, et al., "Development of a High Strength 25Ni—20Cr Austenitic Steel for Ultra Super Critical Boiler Tube," ibid. to the alloy of the invention. The subject alloys are superior to alloy 800H or modified alloy 800H in either MA or RA condition and are better than modified 20Cr—25Ni in the MA condition.

These alloys should have direct application as boiler tubes in advanced steam cycle coal fired power plants. They could also be utilized in any other application suitable for 800H and modified 800H alloys, or for which higher creep strength or creep rupture resistance is needed than can be provided by the 800H alloys. Possible applications include petrochemical or polymer processing industries and as vessel and core components for high temperature gas-cooled reactors or liquid metal fast breeder reactors.

We claim:

1. An austenitic alloy composition comprising in wt% 19–21 Cr, 30–35 Ni, 1.5–2.5 Mn, 2–3 Mo, 0.1–0.4 Si, 0.3–0.5 Ti, 0.1–0.3 Nb, 0.1–0.5 V, 0.001–0.005 P, 0.08–0.12 C, 0.01–0.03 N, 0.005–0.01 B and the balance iron.

2. The alloy composition of claim 1 wherein said composition is subjected to a thermal-mechanical treatment of annealing for up to 1 hour at 1150°–1200° C.

3. The alloy composition of claim 2 wherein said alloy is cold deformed 5 to 15%.

4. The alloy composition of claim 2 wherein said alloy is subjected to hot finishing sufficient to produce yield strength in the range of from 300 to 600 MPa.

* * * * *